US006852027B2

(12) United States Patent
Kaminkow et al.

(10) Patent No.: US 6,852,027 B2
(45) Date of Patent: Feb. 8, 2005

(54) GAMING DEVICE HAVING RATE DEPENDENT GAME

(75) Inventors: Joseph E. Kaminkow, Reno, NV (US); Andrea C. Hughs-Baird, Reno, NV (US)

(73) Assignee: IGT, Reno, NV (US)

( * ) Notice: Subject to any disclaimer, the term of this patent is extended or adjusted under 35 U.S.C. 154(b) by 110 days.

(21) Appl. No.: 09/966,882

(22) Filed: Sep. 28, 2001

(65) Prior Publication Data

US 2003/0064770 A1 Apr. 3, 2003

(51) Int. Cl.[7] ..... A63F 9/24
(52) U.S. Cl. ..... 463/16
(58) Field of Search ..... 463/20–22, 25, 463/16, 40–42, 26; 273/138.1, 138.2, 139, 143 R, 138

(56) References Cited

U.S. PATENT DOCUMENTS 4,363,485 A 12/1982 Edwall
4,582,324 A 4/1986 Koza et al.
4,618,150 A 10/1986 Kimura (List continued on next page.)

FOREIGN PATENT DOCUMENTS

GB 2 096 376 A 10/1982
GB 2 097 160 A 10/1982
GB 2 100 905 A 1/1983
GB 2 137 392 A 10/1984
GB 2 142 457 A 1/1985
GB 2 153 572 A 8/1985
GB 2 161 008 A 1/1986
GB 2 161 009 A 1/1986
GB 2 170 636 A 8/1986
GB 2 180 682 A 4/1987
GB 2 181 589 A 4/1987
GB 2 183 882 A 6/1987
GB 2 222 712 A 3/1990
GB 2 226 907 A 7/1999

OTHER PUBLICATIONS

Ottinger et al., "Press Your Luck", Sep. 19, 1983, Original Game Show page.* gscentral.net, "Roll that Board", Sep. 19, 1982, http://gs-central.net/board.htm.*

Top Dollar Brochure written by IGT published in 1998.

Mikohn Ripley's Believe It or Not Article written by Strictly Slots published in 2001.

Description of Poker written by Hoyle's Rules of Games published 1946–1983.

Job Switching ("Candy Factory") (website) written by www.youns.com, printed Dec. 9, 2003.

I Love Lucy—Episode Guide (website) written by www.tv-lome.com printed Dec. 9, 2003.

I Love Lucy—Season Two: 1952–53 (website) written by http://classicsitcoms.com, printed Dec. 9, 2003.

*Primary Examiner*—Michael O'Neill
*Assistant Examiner*—Christina Marks
(74) *Attorney, Agent, or Firm*—Bell, Boyd & Lloyd LLC

(57) ABSTRACT

The present invention provides a gaming device having a game that may be implemented in a primary or bonus game. More specifically, the present invention provides a processor controlled gaming device that presents a plurality of masked value choices to the player, provides a time period in which the player can elect to accept a masked choice and reveals and provides a value associated with the choice to the player if the player accepts in time. If the player does not accept in time or decides not to accept the choice, the gaming device, in one preferred embodiment, reveals the value the player could have accepted when the time period lapses or times out. When the player has successfully accepted a predefined number of masked choices, the game adds or multiplies the values yielded by the choices to form an award for the player.

36 Claims, 8 Drawing Sheets

U.S. PATENT DOCUMENTS 4,695,053 A 9/1987 Vazquez, Jr. et al.
5,342,047 A 8/1994 Heidel et al.
5,342,049 A 8/1994 Wichinsky et al.
5,542,669 A 8/1996 Charron et al.
5,560,603 A 10/1996 Seelig et al.
5,769,716 A 6/1998 Saffari et al.
5,823,873 A 10/1998 Moody
5,833,536 A 11/1998 Davids et al.
5,873,781 A 2/1999 Keane
5,951,397 A 9/1999 Dickinson
5,967,894 A 10/1999 Kinoshita et al.
5,997,401 A 12/1999 Crawford
6,015,346 A 1/2000 Bennett
6,033,307 A * 3/2000 Vancura ..... 463/20
6,047,963 A 4/2000 Pierce et al.
6,089,976 A 7/2000 Schneider et al.
6,102,798 A 8/2000 Bennett
6,110,039 A 8/2000 Oh
6,110,041 A 8/2000 Walker et al.
6,117,009 A * 9/2000 Yoseloff ..... 463/20
6,120,031 A 9/2000 Adams
6,126,541 A 10/2000 Fuchs
6,126,547 A 10/2000 Ishimoto
6,135,885 A 10/2000 Lermusiaux
6,139,013 A 10/2000 Pierce et al.
6,142,874 A 11/2000 Kodachi et al.
6,159,097 A 12/2000 Gura
6,165,070 A 12/2000 Nolte et al.
6,174,233 B1 1/2001 Sunaga et al.
6,174,235 B1 1/2001 Walker et al.
6,190,255 B1 2/2001 Thomas et al.
6,210,279 B1 4/2001 Dickinson
6,220,593 B1 4/2001 Pierce et al.
6,231,442 B1 5/2001 Mayeroff
6,231,445 B1 * 5/2001 Acres ..... 463/42
6,237,913 B1 * 5/2001 Kamille ..... 273/139
6,238,288 B1 5/2001 Walker et al.
6,261,177 B1 7/2001 Bennett
6,267,669 B1 7/2001 Luciano, Jr. et al.
6,270,409 B1 8/2001 Shuster
6,293,866 B1 9/2001 Walker et al.
6,309,299 B1 10/2001 Weiss
6,309,300 B1 * 10/2001 Glavich ..... 463/26
6,364,768 B1 * 4/2002 Acres et al. ..... 463/25
6,375,187 B1 * 4/2002 Baerlocher ..... 273/143 R
6,413,160 B1 * 7/2002 Vancura ..... 463/16
6,413,161 B1 * 7/2002 Baerlocher et al. ..... 463/20
6,439,995 B1 * 8/2002 Hughs-Baird et al. ..... 463/20
6,506,118 B1 * 1/2003 Baerlocher et al. ..... 463/25
6,569,015 B1 * 5/2003 Baerlocher et al. ..... 463/16
6,582,306 B1 * 6/2003 Kaminkow ..... 463/20
2002/0049084 A1 * 4/2002 Hughs-Baird et al. ..... 463/20
2002/0059252 A1 * 5/2002 Yamaguchi ..... 707/10
2003/0013519 A1 * 1/2003 Bennett ..... 463/25

* cited by examiner

GAMING DEVICE HAVING RATE DEPENDENT GAME

CROSS REFERENCE TO RELATED APPLICATIONS

The present invention relates to the following co-pending commonly owned U.S. patent applications: "Gaming Device Having A Bonus Scheme With Multiple Selection Groups," Ser. No. 09/656,702, "Gaming Device Having Skill/Perceived Skill Bonus Round," Ser. No. 09/682,407, and "Gaming Device Having Perceived Skill, Ser. No. 09/682,408,".

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having one or more time limits to accept award choices which are components of the player's award.

BACKGROUND OF THE INVENTION

Gaming devices provide enjoyment, entertainment and excitement to players, in part, because they may ultimately lead to monetary awards for the players. Gaming devices also provide enjoyment, entertainment and excitement to the players because they are fun to play. Bonus games, in particular, provide gaming device manufacturers with the opportunity to add enjoyment and excitement to that which is already expected from a base game of the gaming device. Bonus games generally provide extra awards to the players and enable the players to play a game that is different than the base game.

Gaming devices are typically games of luck or probability, not skill. Primary games are set up to pay back, on average, a certain percentage of the amount of money wagered by the players. The pay back or payout percentage in most primary games is set high enough that any player who plays a few hands or spins of the reels wins at least one game. That is, in most primary games in gaming devices it is not too difficult to experience some level of success.

Bonus games are typically set up for the player to succeed. The player usually wins an award in a bonus game. In bonus game play, the goal is often to maximize the possible award. Winning, at least on some level, is therefore a standard component in almost all gaming devices. Moreover, the actual payout percentage of any gaming device is ultimately determined by the gaming establishment within the parameters of the rules of the relevant gaming jurisdiction, not the game designer.

A continuing need therefore exists to provide gaming devices that issue awards in an exciting and enjoyable manner. In this respect, it is desirable to enable the player to have an impact on, or a hand in, determining their award. It is also desirable to enable a player to optimize an award. It is further desirable to increase the level of player interaction. Each of these features is desirable in primary and secondary games.

SUMMARY OF THE INVENTION

The present invention provides a gaming device having a game that may be implemented in a primary or secondary game. More specifically, the present invention provides a processor controlled gaming device that presents a plurality of masked choices or selections to the player, provides a time period in which the player can elect to accept one or more masked choices or selections and reveals and provides a value associated with the choices or selections to the player if the player accepts within the time period. If the player does not accept within the time period or decides not to accept the choice or selection, the gaming device, in one preferred embodiment, reveals the value or values the player could have accepted when the time period lapses or times out.

In one embodiment of the present invention, the gaming device defines or sets a number of masked choices or selections that the player can accept. When the player accepts that predefined number of masked choices or selections, the gaming device adds or multiplies the values associated with the selected choices to form an award that the game provides to the player. The award includes at least one and preferably a plurality of values associated with masked choices or selections that the player has selected within the allotted time period(s). The lapsing of one or more time periods to select masked choices or selections does not deprive the player the player's opportunities to select the masked choices or selections. Rather, the processor of the gaming device provides another group of masked choices or selections to the player. The subsequent group of masked choices or selections may have different values or characteristics as discussed below. The player picks until all of the player's opportunities are exhausted.

The player attempts to maximize the award by accepting masked choices that yield relatively high awards. In one embodiment, the gaming device displays a current range of possible values associated with the currently available selections so that the player can gauge whether a decision to accept or not accept a masked choice or selection is a good one. The gaming device may also display a clock that counts down the time that the player has left to select one or more masked choices or selections. The gaming device also displays the values that the player has selected, which will eventually form the player's award.

When the player selects a masked choice, the gaming device provides a value. The gaming device may also generate a rate change, velocity change or speed-change, primarily referred to herein as a speed-change. A speed-change changes and preferably lessens the amount of time that the player has to decide whether to choose a subsequent masked choice or selection. The speed change thus speeds up or slows down and preferably speeds up the player's decision making process. A speed-change in a preferred embodiment also signals or initiates a change and preferably an increase in the average value of the value range for the available masked choices or selections. That is, the speed-change, in one preferred embodiment, raises the stakes and lessens the amount of the player's decision time which increases the player's excitement and enjoyment in the game. The gaming device may also display the new range.

The speed-changes are therefore desirable to the player because they increase the average value of subsequently obtained values. The gaming device may contain any suitable number of speed-changes, and thus, any suitable number of increasing value ranges. The player desires to obtain as many speed-changes as possible and as soon as possible so that the player's allotted number of opportunities to select masked choices or selections are filled with values from subsequent relatively high value ranges. In a preferred embodiment, the speed-changes become harder to obtain in higher value ranges. That is, each value range includes a speed-change entry, wherein the ranges are weighted so that entries in subsequent ranges have lower probabilities. The values in the ranges are also weighted in accordance with the game mathematics.

As described above, in one embodiment, a clock or counter counts time until the time for accepting or selecting masked choices or selections is up and the particular choice (s) or selection(s) can no longer be accepted or selected. In one preferred embodiment, the time period is set by speed or velocity and distance. In one implementation, a masked choice moves at a predefined speed, velocity or rate through a stationary acceptance zone having a distance parallel to the direction of movement. The distance of the acceptance zone along the direction of travel divided by the speed yields the time that the player has to make a decision, wherein the player must accept a choice when it is within the acceptance zone to obtain the value associated with the choice. Other variations of the speed/distance method of providing a time period include holding the choice stationary and moving an acceptance zone over the choice, wherein the dimensions of the choice define the distance relevant to determining the time period.

Upon a speed-change, the gaming device changes or increases the speed of the moving object or choice. Alternatively, the game may not adjust the speed, but adjust or decrease the acceptance distance through which the choice or selection moves.

One preferred game theme of the gaming device involves a candy manufacturing operation, wherein the player picks desired pieces of candy (selections or masked choice) to place in a candy box (displaying values associated with the choices or selection). The speed changes are associated with certain candies and include increasing the conveyor speed, which is in accordance with the preferred theme.

It is therefore an advantage of the present invention to provide a gaming device that presents masked value choices to the player and provides a certain amount of time for the player to accept or not accept values associated with the choices.

It is a further advantage of the present invention to provide a gaming device which provides a speed-change that changes the player's decision time and the range of potential values.

It is yet another advantage of the present invention to define the time period for acceptance using an object moving at a given speed or rate through a given acceptance distance.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
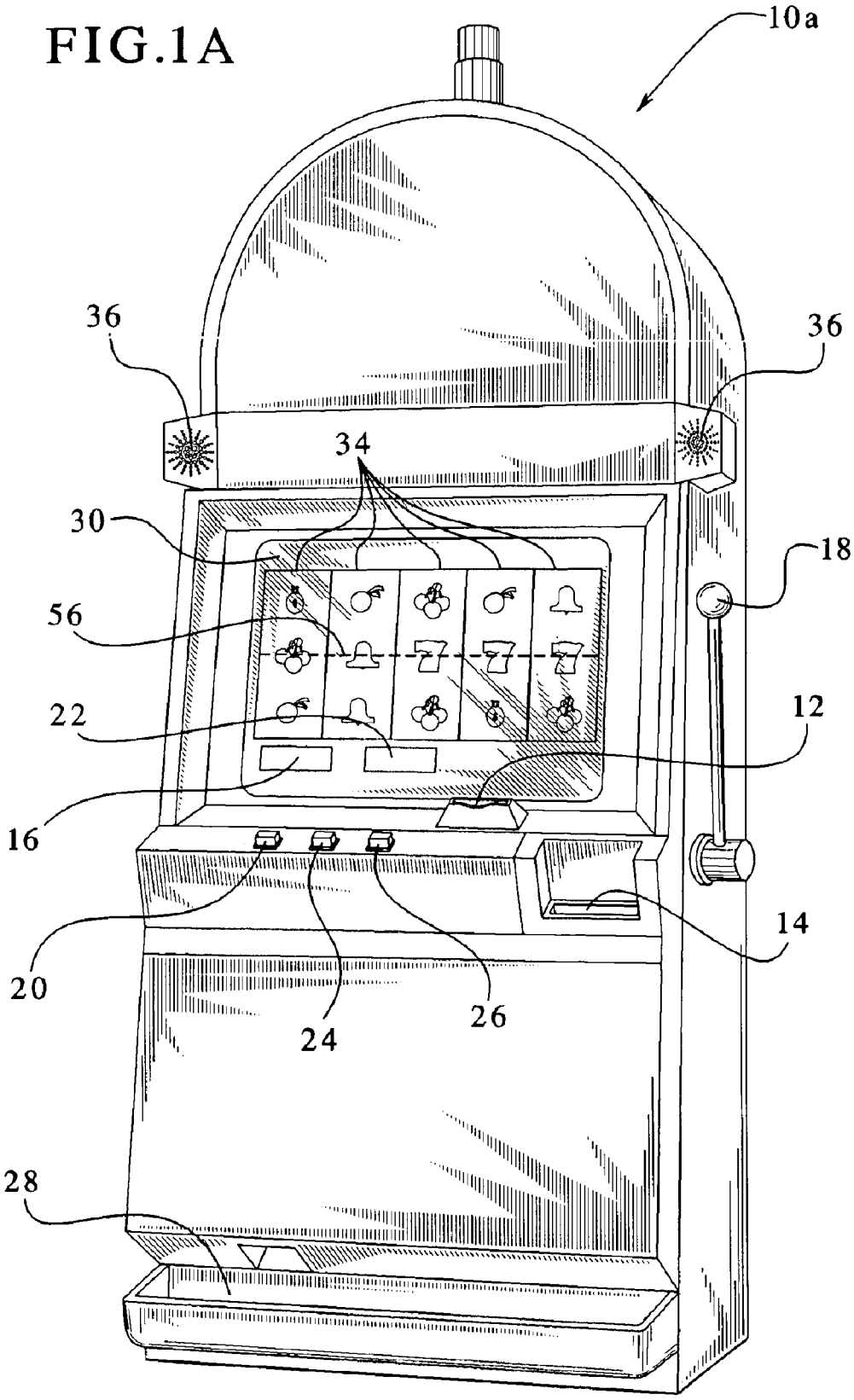
FIGS. 1A and 1B are perspective views of alternative embodiments of the gaming device of the present invention.
Figure 1B:
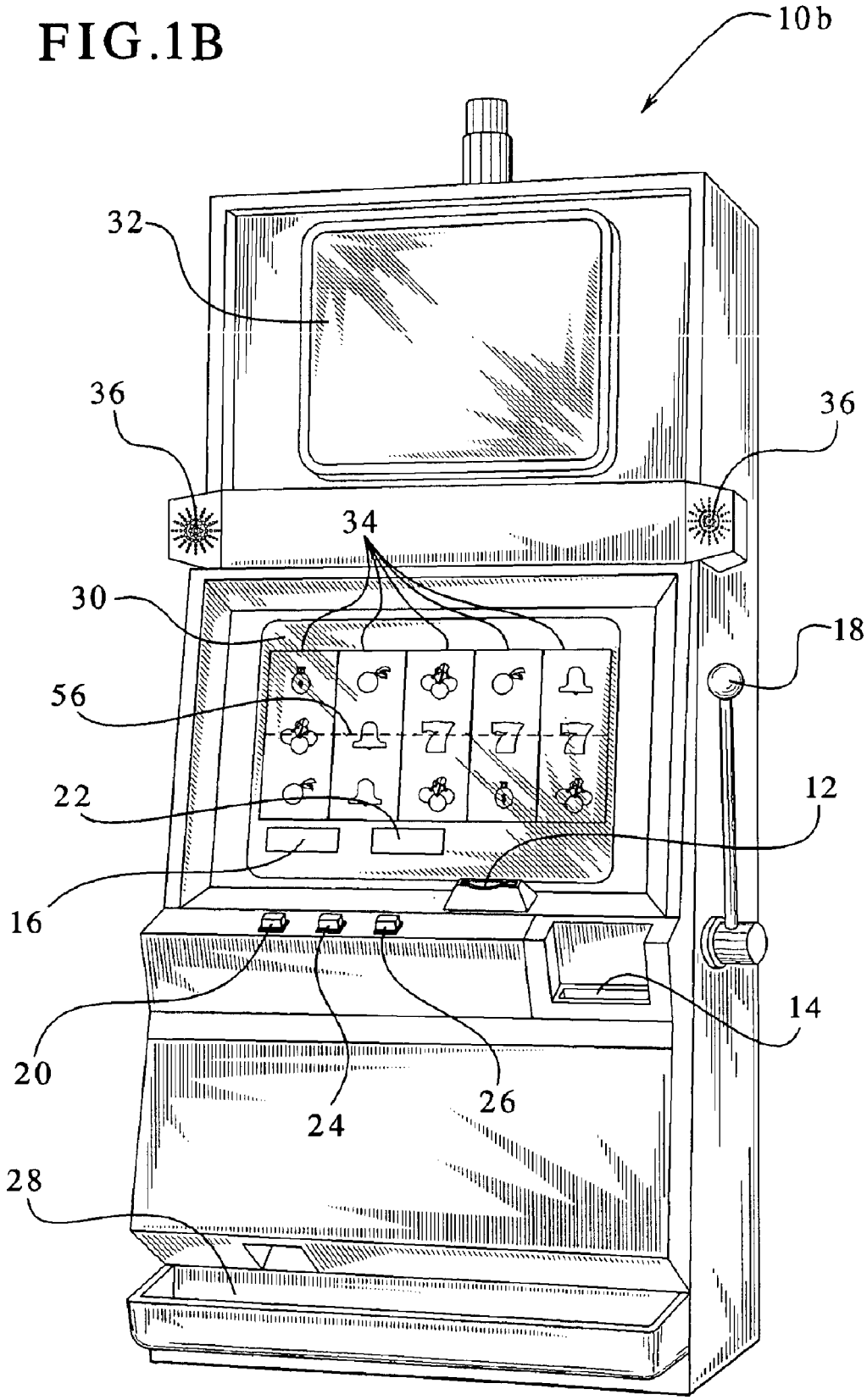

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game (described below) being a stand alone game or a bonus or secondary game that coordinates with a base game. When the game of the present invention is a bonus game, gaming device 10 may have any base game such as a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack or keno, among others. The gaming device 10 also embodies any bonus triggering events, bonus games as well as any progressive game coordinating with these base games. The symbols and indicia used for any of the base, bonus and progressive games include mechanical, electrical or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time during the game, a player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 preferably displays a plurality of reels 34, preferably three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially in the slot machine base game of the gaming device 10, includes speakers 36 for making sounds or playing music.

Figure 2:
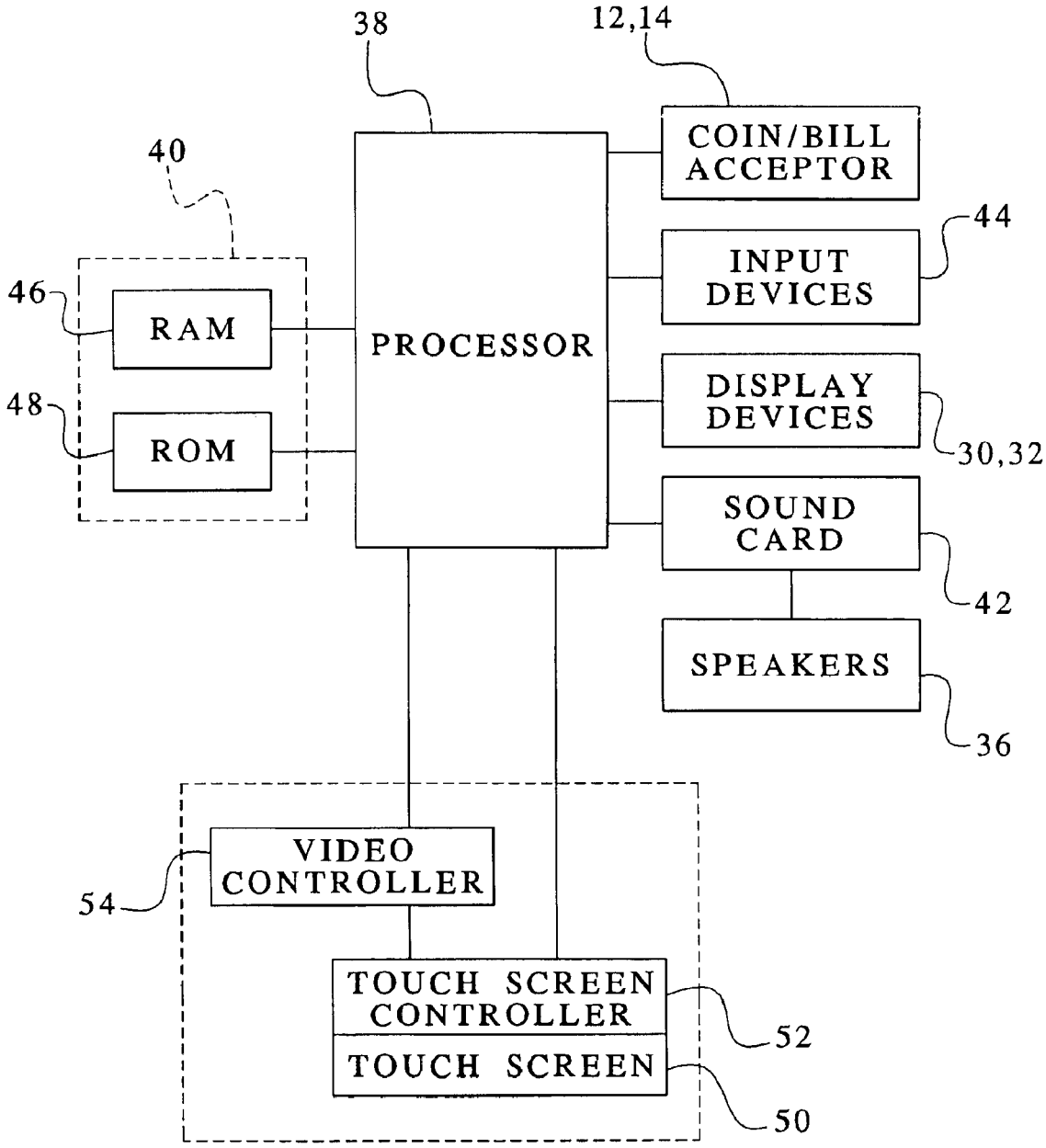
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 may employ a video-based display device 30 or 32 for the bonus games. The bonus games include a program that automatically begins when the player achieves a qualifying condition in the base game.

In the slot machine embodiment, the qualifying condition may include a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the present invention includes one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

Award Choices or Selections Having a Time Period for Acceptance

Figure 3:
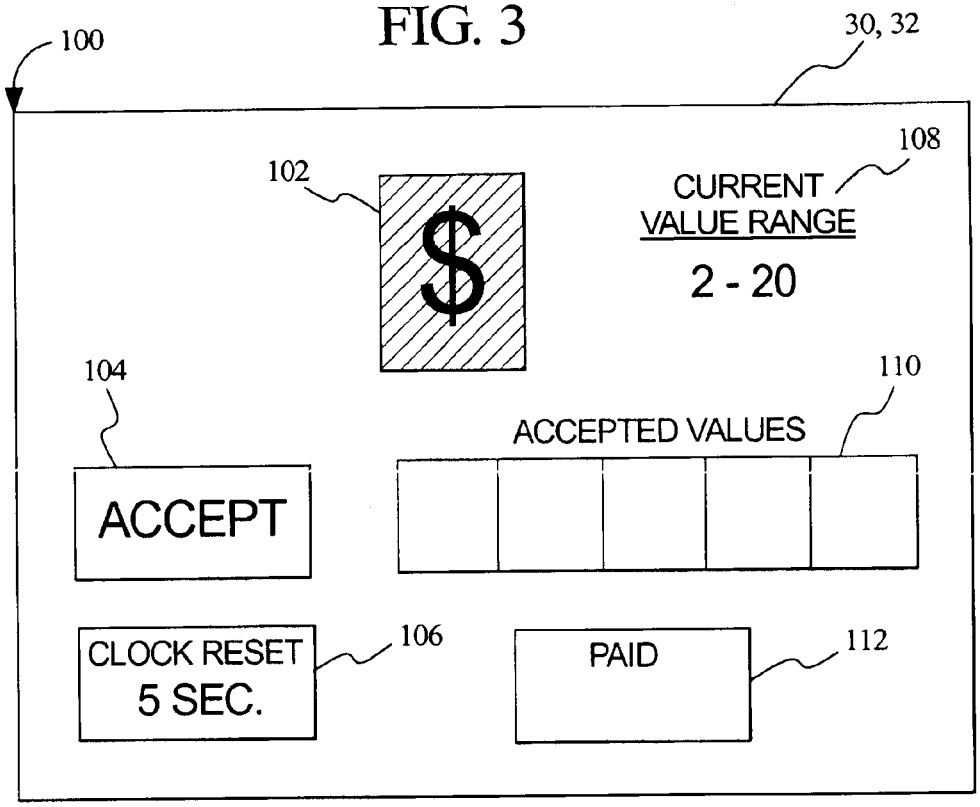
FIG. 3 is an elevation view of a display device illustrating a masked value choice or selection of the present invention.

Referring now to FIG. 3, one of the display devices 30 or 32 of gaming device 10 displays an initial screen 100 of one embodiment of the present invention. The screen 100 includes a masked choice or selection 102, an accept input 104, a clock 106, a current value range display 108, an accepted values display 110 and a paid display 112. The selection 102 hides one of the values of the current range shown in the display 108. In the illustrated embodiment, the selection 102 displays a dollar sign. In other implementations, suitable audio and/or visual messages may be provided to inform the player that the selection 102 hides, conceals or generates a value.

The display device 30 or 32 in a preferred embodiment includes a touch screen 50 and a touch screen controller 52, which communicates with the processor 38 of gaming device 10, as disclosed in connection with FIG. 2. The acceptor or accept input 104 is an area of the touch screen 50 that sends a discrete input to the processor 38. The processor 38 communicates with the memory device 40 that stores a game program, which has been configured to recognize the discrete input as the player's acceptance of the currently displayed selection 102. That is, if the player wants whatever value is concealed by the selection 102, the player presses the simulated acceptor or accept input 104.

In an alternative embodiment, the acceptor or accept input 104 is an electromechanical input, located on a panel of the gaming device 10, which is a hard-wired input device 44 (FIG. 2). The electromechanical accept input 104 sends a discrete input to the processor 38, as described above.

The clock 106 counts time up or down as desired by the implementor. As illustrated in FIG. 3, the clock has been reset to an initial time period of five seconds. The time periods set a length of time that the player has to decide whether or not to accept a selection 102. The lengths of time may be set as desired by the implementor.

The current value range display 108 displays the current range of values that gaming device 10 selects from awards for the player when the player accepts a selection 102. The value ranges may be set as desired by the implementor.

The accepted values display 110 displays the values that the player has been awarded. The player's ultimate award, shown in the paid display 112, includes at least one and preferably a plurality of values awarded when the player selects the acceptor or accept input 104 within the length of time provided by the clock 106. Before the player acquires each of the values that make up the award shown in the paid display 112, the player can gauge their relative success by comparing the accepted values shown in the display 110 with the range or ranges shown in the display 108.

Figure 4:
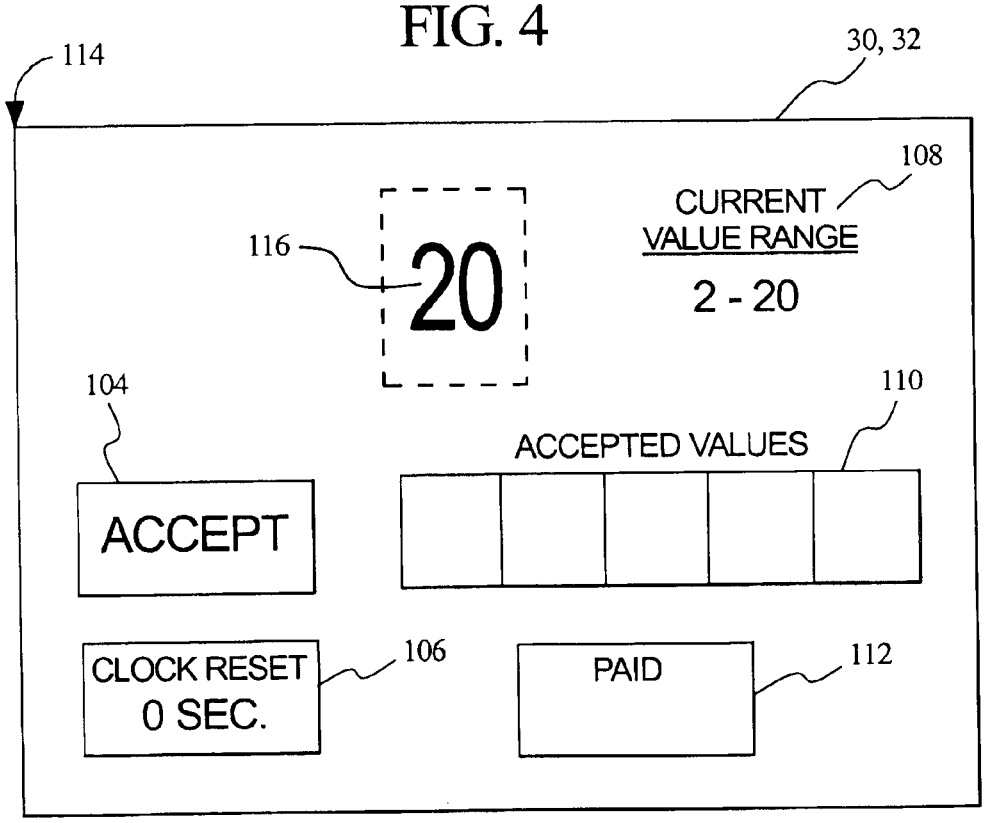
FIG. 4 is an elevation view of a display device illustrating a value that has been revealed after a time period has timed out.

Referring now to FIG. 4, a screen 114 illustrates that if the player does not select the acceptor or accept input 104 before the clock 106 times out, gaming device 10 no longer enables the player to accept the provided choice 102. In one preferred embodiment, to increase excitement and enjoyment, the game reveals the value 116 (indicated within the masked choice border which is shown in phantom) that the player would have received had the player selected the acceptor or accept input 104 within the time limit. In this example, after the clock 106 times out to zero seconds as indicated in the clock in FIG. 4, a twenty value 116 is revealed. A player who observes the current value range in the display 108 notices that the lost opportunity is at the top of the current range. Selecting the accept input 104 after the clock 106 has timed out, however, does the player no good.

Figure 5:
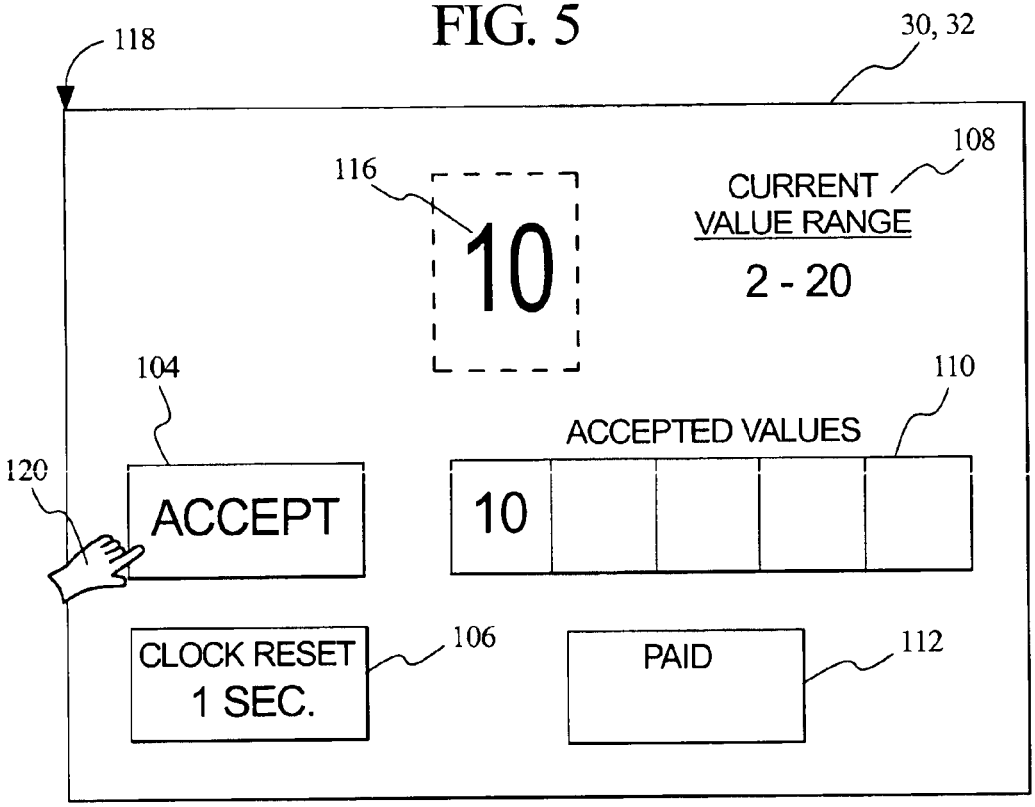
FIG. 5 is an elevation view of a display device illustrating a value that has been revealed after the player has accepted a choice within an allotted time period.

Referring now to FIG. 5, a screen 118 illustrates that if the player does select the acceptor or accept input 104 before the clock 106 times out, i.e., while the clock is still counting down, the gaming device 10 provides or awards the value 116 that has been assigned to the newly displayed selection 102 (not illustrated). That is, when the player lost the opportunity to accumulate the twenty value 116 in the screen 114, gaming device 10 provided another selection 102 (not illustrated). The clock was reset to the initial length of time, e.g., five seconds, and began to count down. This time, with one second left on the clock 106, the player 120 selected the accept input 104. The game thereafter revealed and awarded the ten value 116 assigned to the new selection 102, which is within the current range as shown in the display 108.

When the player accepts a selection 102, gaming device 10 displays the value 116 assigned to the accepted choice in the accepted value display 110. The screen 118 illustrates the ten value in the display 110. The display 110 shows in this example that five value positions will be filled before the gaming device 10 will actually download any game credits to the paid display 112. Accordingly, the player has a plurality of opportunities to select masked choices or selections from a plurality of potential choices or selections. It should be appreciated that the player will receive five values 116 regardless of how many selections 102 the player either decides not to accept or attempts to accept too late (e.g., as in the screen 114).

It should be appreciated that the processor of the gaming device randomly selects the value range for each available choice or selection. The average ranges preferably vary. Thus, the player has an opportunity to select choices from different ranges in limited time periods. It should also be appreciated at this point that this embodiment can operate without the current value range display 108. The game designer may or may not wish to divulge the current value range. The value range display 108 provides additional information to the player which makes the game more exciting for the player.

Figure 6A:
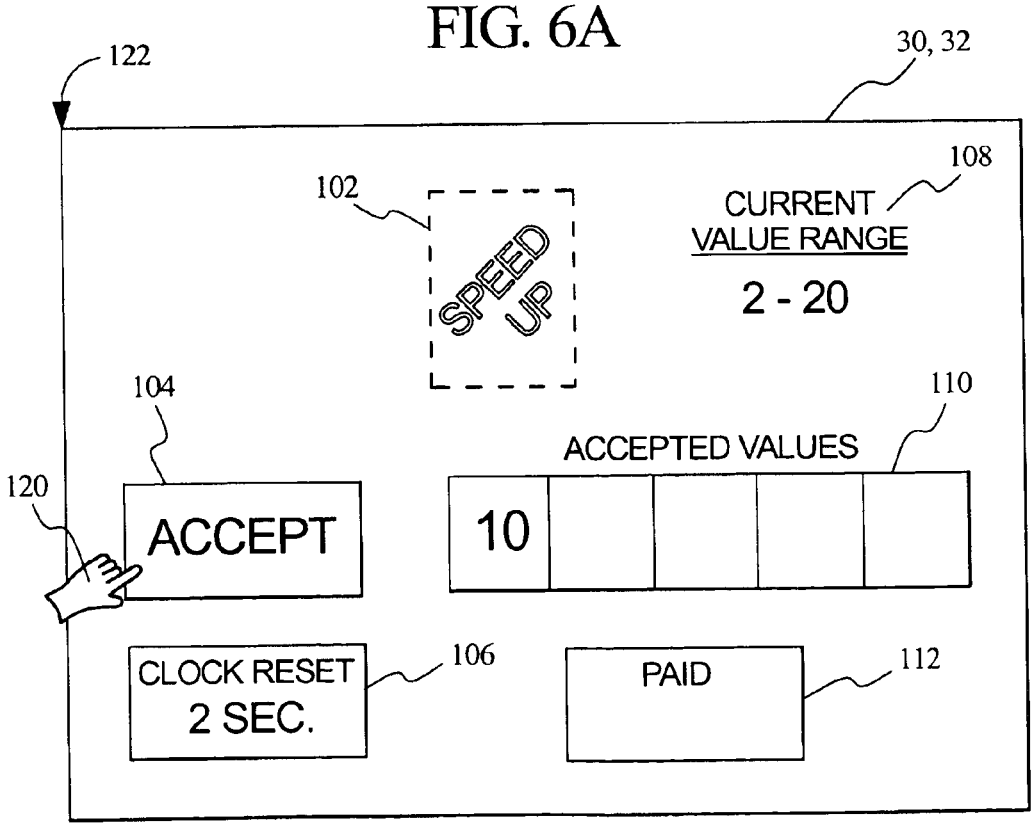
FIGS. 6A and 6B are elevation views of a display device illustrating the speed-change function of the present invention.
Figure 6B:
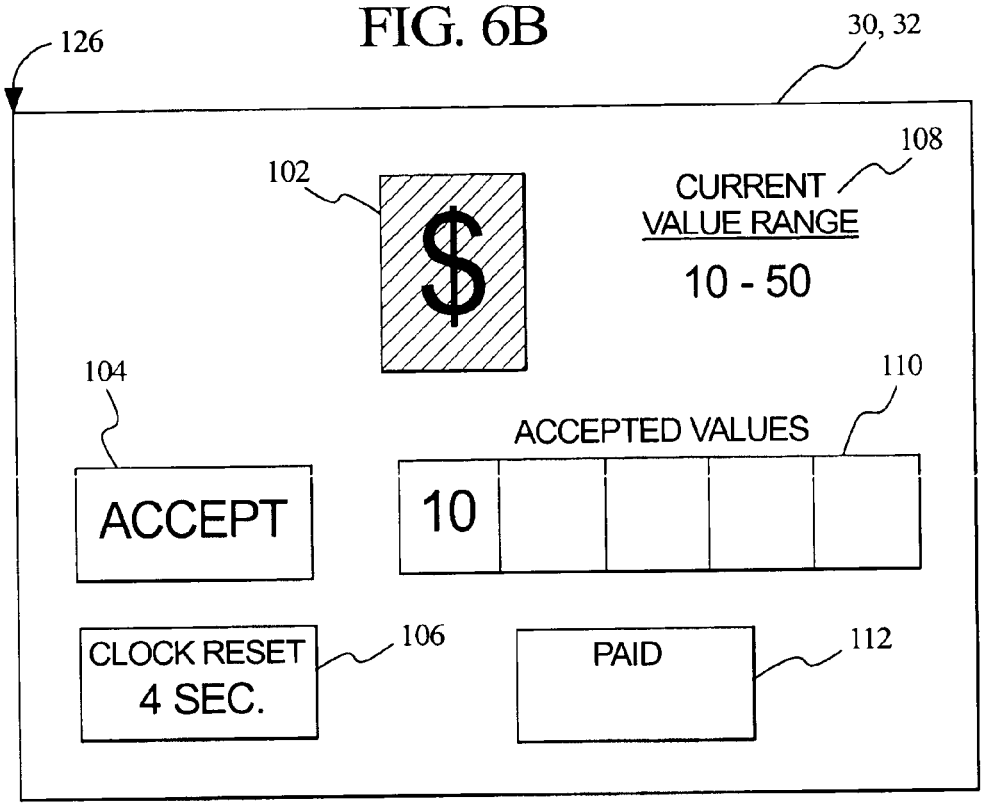

Referring now to FIGS. 6A and 6B, a rate-change or speed-change feature of the present invention is illustrated. Because the accepted value display 110 is not yet full after the player receives the ten value 116 in the screen 118, gaming device 10 resets the time period on the clock 106 to the initial length of time and displays a new selection 102 (not illustrated). As illustrated in the screen 122 of FIG. 6A, when the player 120 selects the accept input 104 with two seconds left on the clock 106, the game reveals and provides the player with a speed-change 124 indicated by the word "SPEED UP", which has been assigned to the new selection 102.

The speed-change 124 decreases the time in which the player must subsequently decide whether to select the accept input 104. In an embodiment, the speed-change 124 also accompanies a change in the current value range. In a preferred embodiment, the average value of all of the subsequent value ranges increases upon the obtaining of a speed-change. The speed-change in the preferred embodiment increases the fun and excitement of the gaming device 10 by raising the stakes and giving the player less time to make a decision.

The screen 126 of FIG. 6B illustrates the effects of a speed-change 124. Gaming device 10 presents a new selection 102 to the player. The clock 106 is reset to a new, preferably lesser, time period such as four seconds as illustrated in FIG. 6B. A new, preferably larger, value range is displayed in the display 108. The player now has only four seconds to decide whether to select the accept input 104, and an accepted selection 102 provides a value in the range of ten to fifty, as illustrated by display 108, instead of two to twenty as before.

In the illustrated embodiments, the speed-change 124 does not include an associated value 116 that appears in the accepted values display 110. Accordingly, the speed-change does not take up or use any of the player's opportunities to obtain values. The speed-change instead changes the subsequent value range. In alternative embodiments, however the speed-change 124 may be adapted to provide a value, a separate award, increment a multiplier meter, provide a component necessary for a progressive award, or any other suitable function.

Figure 7:
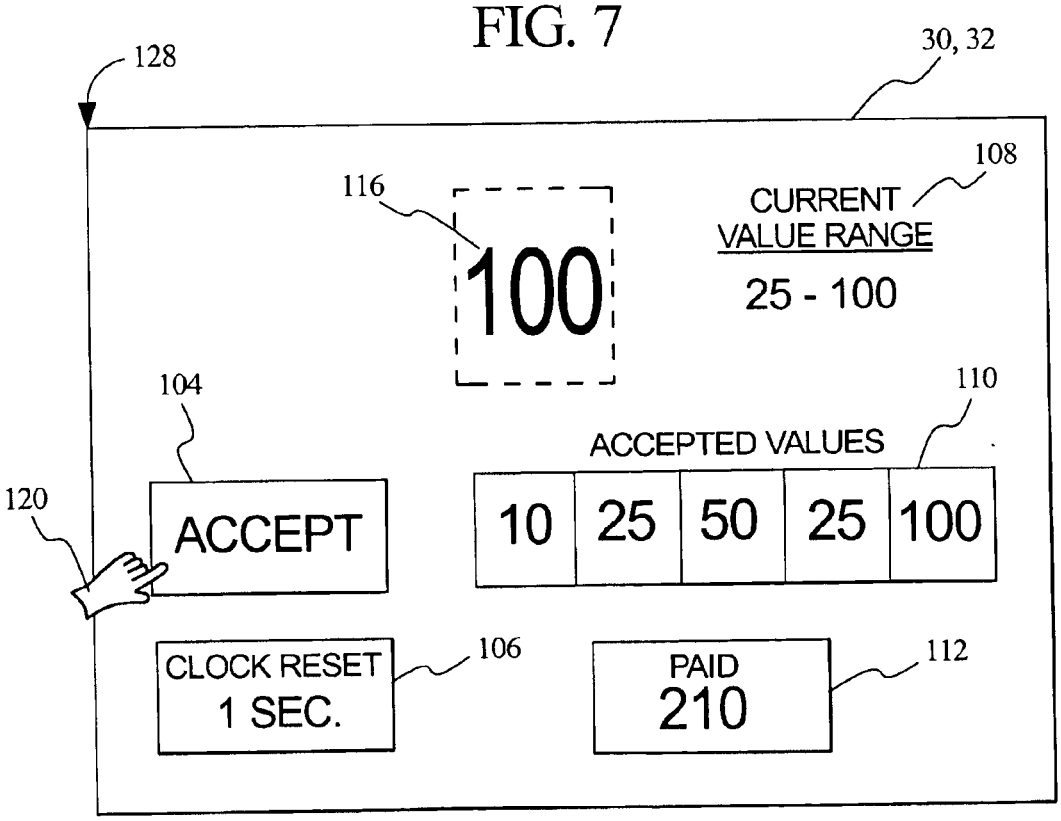
FIG. 7 is an elevation view of a display device illustrating an award provided to the player after the player has successfully accepted a predefined number of choices.

Referring now to FIG. 7, a screen 128 illustrates the point at which gaming device 10 provides or downloads an award to the player. With the accepted values display 110 nearly full (not illustrated), the player 120 selects the accept input 104 with one second remaining on the clock 106. The accepted choice yields the highest possible value 116 of the range shown in the display 108, namely, the one hundred value 116. The one hundred value 116 completes the predefined number of values necessary for gaming device 10 to issue an award to the player. Although the screens 100, 114, 118, 122, 126 and 128 predefine the number of values 116 to be five, gaming device 10 may be adapted to predefine any number of values 116, including a single value. Gaming device 10 adds the values in the accepted value display 110 to form the award of two hundred ten, shown in the paid display 112. In an alternative embodiment, gaming device 10 can multiply or add a portion and multiply a portion of the values in the display 110.

The award provided or downloaded to the player in the paid display 112 is in one embodiment a number of game credits. In another embodiment, the award may be a multiplier that multiplies some other number or amount of game credits such as the player's total bet, a bet per payline, the number of paylines wagered, a win along a payline, a total win along all wagered paylines, a win in a scatter pay, etc. The award may further alternatively signify a number of picks from a prize pool.

Figure 8:
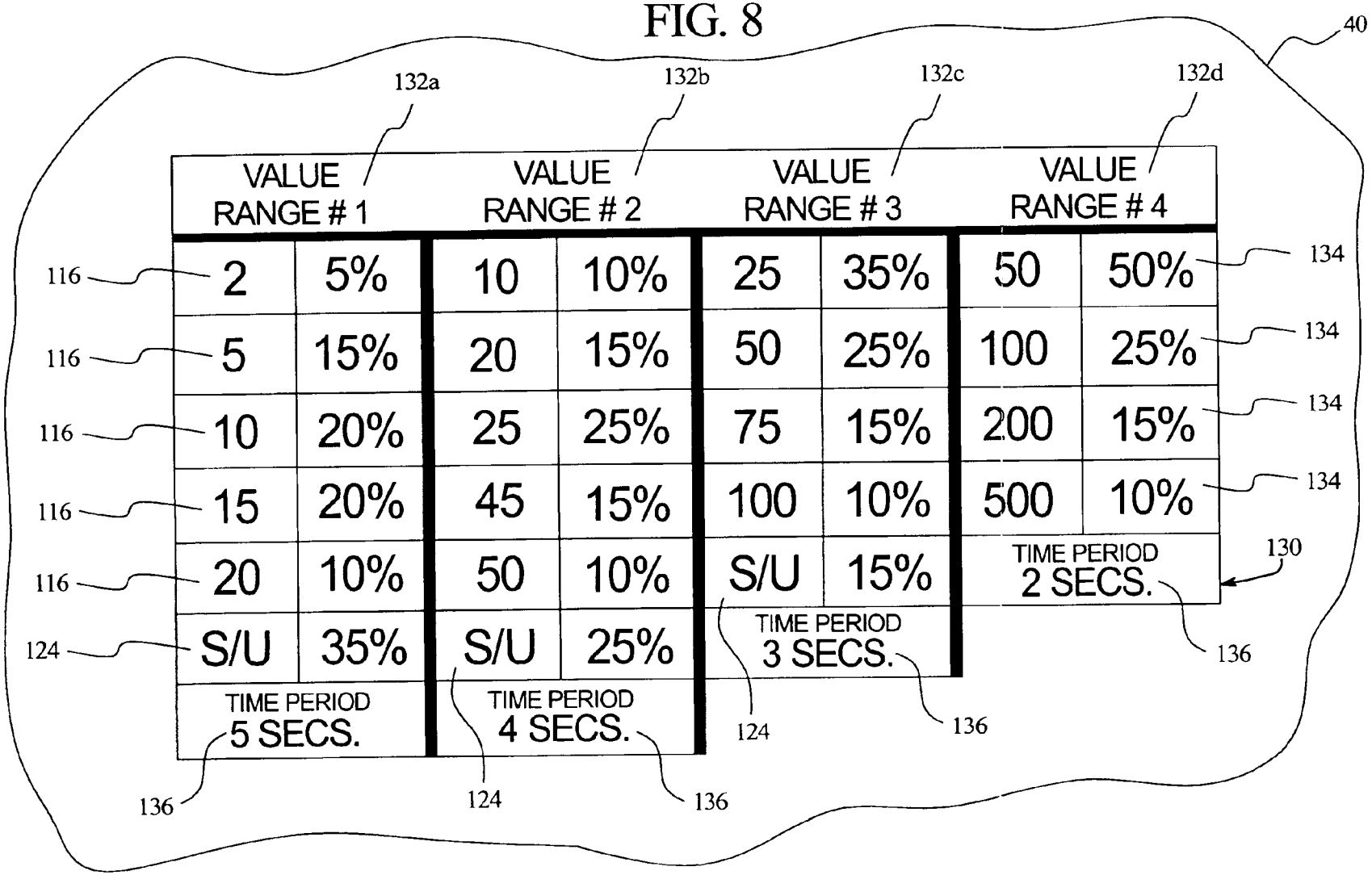
FIG. 8 is a schematic diagram illustrating one embodiment of a data table of the present invention having a plurality of value ranges each of which include a time period, a probability distribution for the value entries and a speed-change entry.

Referring now to FIG. 8, an area of the memory device 40 stores a data table, database or data that has otherwise been entered into the game program, which is referred to hereafter as data table 130. The table 130 includes four value ranges 132*a* through 132*d*. Each of the first three value ranges 132*a* through 132*c* includes a speed-change entry 124 designated by S/U. In a gaming device 10 employing the data table 130, the player can possibly obtain a speed-change three times and select from four different value ranges before obtaining the predefined number of values 116. Gaming device 10 may alternatively store and employ any number of value ranges, such as ranges 132*a* through 132*d*, wherein all but the last range preferably include a speed-change entry 124.

As illustrated by the table 130, the value ranges can vary the number of value entries 116 in accordance with the game mathematics. Each of the value entries 116 and the speed-change entry 124 has, in one embodiment, an associated probability percentage 134. The probability distributions defined by the probability percentages 134 of each value range are also made according to desired game mathematics. The value ranges 132*a* and 132*b* illustrate bell-shaped distributions for the values 116, wherein the central values 116 are more likely to be randomly generated than are the periphery values 116. The value ranges 132*c* and 132*d* illustrate tapering distributions for the values 116, wherein higher values 116 are less and less likely to be generated.

The percentages allotted to the speed-change entries 124 in a preferred embodiment taper off in advancing value ranges. Since the value ranges preferably sequentially increase in average value, gaming device 10 makes advancing to these ranges increasingly difficult. It should be appreciated that an optimal game under the data table 130 includes picking three speed-changes 124 in a row so that the player can fill up the accepted value display 110 (FIGS. 1 to 7) with values 116 from the highest average value range 134*d*. The player therefore does not want to fill any value positions from the range 132*a* and the data table 130 obliges by making advancing to the value range 132*b* relatively easy. To advance to the final ranges 132*c* and 132*d*, however, may take a considerable amount of luck depending on the number of value positions of the value display 110.

Data table 130 illustrates one embodiment wherein the same value 116 of a given range may be recycled or used again. The player may therefore receive the same value two or more times while accepting masked choices in a given range. In an alternative embodiment, gaming device 10 can employ a game program that is configured not to recycle values, i.e., to remove a valve from possible selection.

Each value range 132*a* through 132*d* has an associated time period 136. The table 130 decreases the length of time in successive time periods 136 for reasons described above. Alternatively, gaming device 10 does not change the time periods 136 or further alternatively increases the lengths of time in successive time periods 136.

In an alternative embodiment (not illustrated), one or more of the value ranges 132*b* to 132*d* can include a speed-change entry that slows the game down. A "speed-decrease" entry has essentially an opposite effect from the preferred "speed-increase" entries. That is, when the player accepts a choice 102 by pressing the accept input 104 and a speed-decrease is randomly provided, the amount of time that the player has in which to decide whether to select the accept input 104 increases. The additional amount of time to accept a choice may also be accompanied by a change in the current value range from a range having a higher average value to a range having a lower average value.

In the value ranges 132*a* to 132*d* of FIG. 8, the speed-decrease might, for example, make gaming device 10 switch from the range 132*d* having a time period 136 of two seconds to the range 132*c* having a time period 136 of three seconds. The values 116 of the range 132*c* are on average less than the values 116 of the range 132*d*. Obviously, a speed-decrease in the value range 132*a* would have no effect. The speed-decrease entries are weighted according to the desired game mathematics.

In another alternative embodiment, a particular speed-increase entry or a speed-decrease entry may be adapted to jump one or more levels or ranges to another or to the highest or lowest ranges, respectively. For instance, a "super" speed-change entry may be adapted to cause a player playing in the range 132*b* to thereafter play in the range 132*d*.

In a further alternative embodiment (not illustrated), one or more of the value ranges 132*a* to 132*d* can include an "increase-picks" entry, which is weighted according to the desired game mathematics. The increase-picks entry increases the number of opportunities that the player has to accept the selections. Upon the generation of an increase-picks entry, the accepted values display provides additional areas for values 110. It should be appreciated that the increase-picks entry is desirable for the player and operates to increase the player's overall award downloaded to the paid display 112.

In yet another alternative embodiment, each range of values (even the last value range 132*d*) includes at least one speed-change or terminator and if the player obtains all of the speed-changes or terminators, the game ends. Thus, in this embodiment, while the player desires to obtain certain speed-changes, the player does not desire to obtain all of the speed-changes.

Time Period Determined by Speed and Distance

Figure 9:
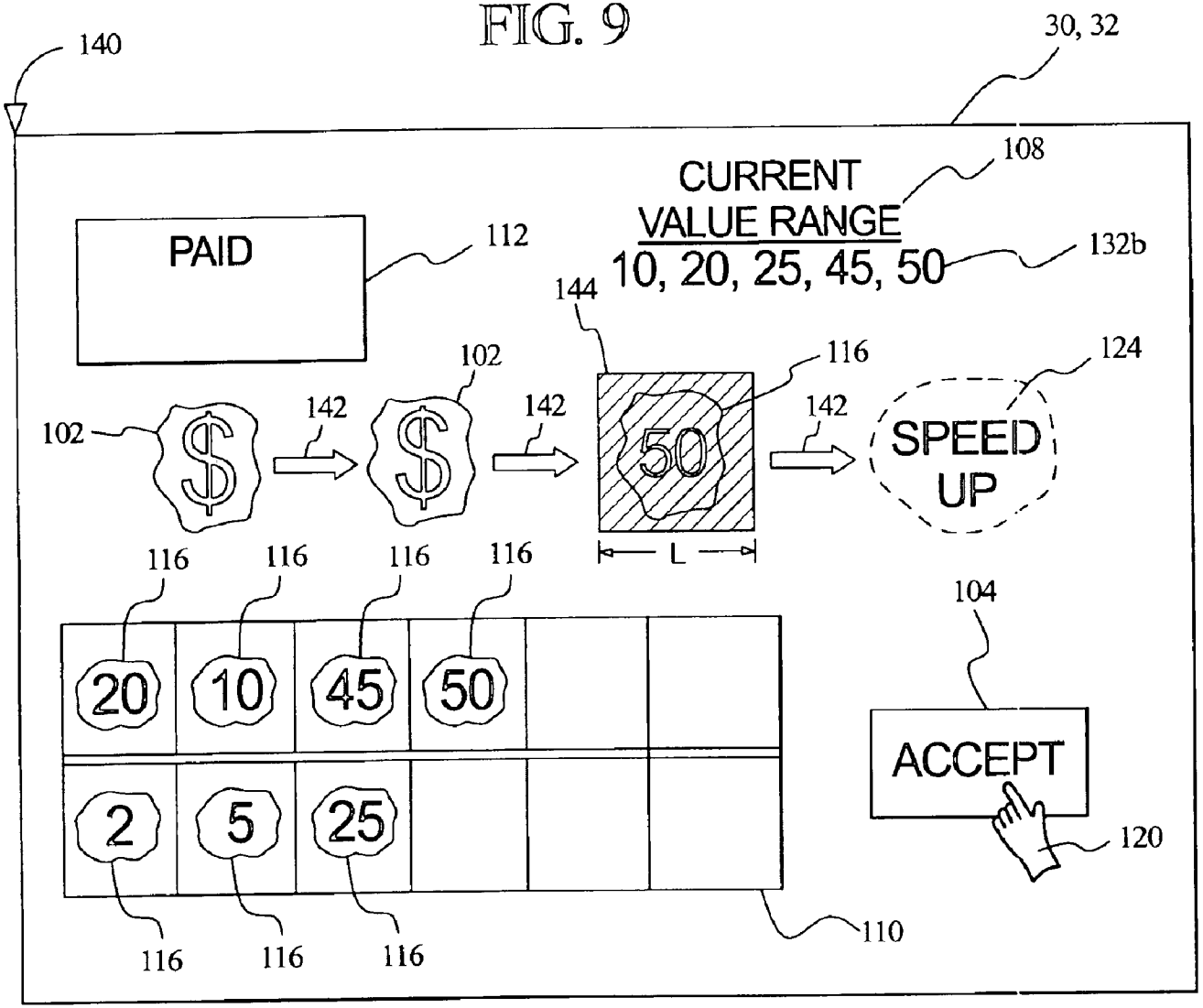
FIG. 9 is an elevation view of a display device illustrating a method of providing a time period by moving an object at a known speed through a known acceptance distance.

In the embodiments disclosed in connection with FIGS. 3 to 7, the time periods are set by a counter and the masked choices have been displayed sequentially. In one preferred embodiment of the present invention illustrated by the screen 140 of FIG. 9, the time period is set by speed, velocity and distance and the selections 102 may, but are not required to be, displayed continuously. The screen 140 depicts a simplified version of a preferred implementation of the present invention, wherein the selections 102 are pieces of candy moving on a conveyor belt (not shown) in a direction defined by the arrows 142. The accepted value display 110 is a candy box, wherein the player's choices reveal candy values 116 that gaming device 10 places into the box 110.

The screen 140 includes the optional current value range display 108, which shows that the range 132*b* described above in FIG. 8 is the current range. Also, the screen 140 illustrates each value of the range 132*b*, which enables the player to clearly see whether a revealed selection 102 has a relatively high or low value 116. The presently illustrated embodiments are operable with the table 130 of FIG. 8. The player has already played through the range 132*a* of the table 130, wherein accepted selections 102 yielded the twenty, two, ten and five values 116. The player then obtained a speed-change 124 and invoked the current range 132*b*, wherein accepted choices previously yielded the forty-five and twenty-five values 116. The player has yet to achieve the predetermined number of values 116, which in the display box 110 of the screen 140 is twelve. The paid display 112 therefore shows that no award has yet been determined or downloaded.

The screen 140 shows that the player let a masked speed-change 124 (shown with a border in phantom) pass through an acceptance area or zone 144 without selecting the accept input 104. The acceptance zone 144 defines a distance "L" on the display device 30 or 32, which is parallel to the direction of travel of the selections 102. The predefined distance "L" divided by the speed of the selections 102 provides the time period that the player has to accept a choice 102. The screen 140 illustrates that the player 120 successfully times the selection of the input 104, so that the fifty value 116 is revealed and provided to the player in the accepted values display 110.

It should be appreciated that the speed/distance method of determining a time period may be implemented in a number of ways. First, the game software may be configured so that the choice 116 only has to touch the zone 144 defining the distance "L." In such case, the time is a function of the distance "L" and the length of the selection parallel to the direction of travel arrow 142. For instance, the time may be a function of the distance "L" plus twice the length of the selections. Alternatively, the selection 102 may have to be completely encompassed within the length "L" as illustrated by the screen 140. Second, the distance may alternatively be set by the selection 102, wherein the stationary area 144 is only a bar or line. Here, the time is equal to the length of the selection divided by the speed of the selection. This implementation is akin to trying to pick a horse while it crosses a finish line, wherein the length of the horse is the length "L." Third, an embodiment includes configuring the display device 30 or 32 so that the selection(s) 102 are stationary and the area or bar 144 moves.

When the player obtains a speed-change in the presently illustrated embodiments, either the speed or velocity of the moving object changes or the distance changes. In the candy wrapping embodiment of the screen 140, the conveyor speed changes so that the candy selection(s) 102 move more quickly. Alternatively, the distance "L" or further alternatively the length of the choice parallel to the length of travel could shrink. Each of the outcomes contemplated for the speed-changes 124 preferably decrease the amount of time that the player has to select the accept input 104 to accept any particular candy selection 102. As described above, when the player obtains the predefined number of values 116, gaming device 10 multiplies or preferably adds the values 116 to determine the player's award, which is provided in the paid display 112.

Thus, it should be appreciated that the player desires to obtain speed-changes to select subsequent choices from higher value ranges to obtain all of the players values which combine to equal the player's total award.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

This invention is claimed as follows:

1. A gaming device comprising:

a display device;

a processor that communicates with the display device;

a plurality of selections that are each at least partially sequentially and individually presented to a player for a limited time period for said selection by the display device under the control of the processor, each said limited time period displayed to the player by said display device, wherein one of the selections yields a speed-change that decreases the limited time period for at least one subsequent selection from a first length of time to a second length of time;

an input in communication with the processor for enabling the player to accept each selection during said limited time period for said selection; and an award provided to the player that includes values associated with each of the selections accepted by the player during the limited time periods respectively of said selections.

2. The gaming device of claim 1, wherein number of selections is predefined.

3. The gaming device of claim 2, wherein one of the selections yields an increase-picks that increases the predefined number of selections that may be selected by the player.

4. The gaming device of claim 1, which includes a first value range for each of the selections presented when the limited time period is the first length of time and a second value range for each of the selections presented when the limited time period is the second length of time.

5. The gaming device of claim 4, wherein the value ranges are weighted so that at least one value in the range is randomly selected more often than at least one other value.

6. The gaming device of claim 4, wherein the second value range includes a speed-change entry.

7. The gaming device of claim 4, wherein the second value range has a larger average value than the first value range.

8. The gaming device of claim 4, wherein the value range which is a current value range is displayed by the display device.

9. The gaming device of claim 4, wherein values of the value range which is a current value range are displayed by the display device.

10. The gaming device of claim 4, wherein the award provided to the player includes values from a predefined number of the selections accepted within the first and second lengths of time.

11. The gaming device of claim 10, wherein the award provided to the player is a mathematical combination of the values associated with a predefined number of selections, the combination selected from the group consisting of: addition and multiplication.

12. The gaming device of claim 1, wherein values associated with non-accepted selections are revealed by the display device after the limited time periods have lapsed.

13. The gaming device of claim 1, wherein the display device includes a touch screen and the input includes an area on the touch screen.

14. The gaming device of claim 1, wherein the values not accepted by the player are displayed by the display device.

15. A gaming device comprising:

a display device;

a processor that communicates with the display device;

a plurality of selections that are each at least partially sequentially and individually presented to a player for a limited time period for said selection by the display device under the control of the processor, the limited time period for said selection displayed to the player by the display device, wherein one of the selections yields a speed-change that decreases the limited time period for at least one subsequent selection from a first length of time to a second length of time;

an input in communication with the processor for enabling the player to accept each selection during the limited time period for the selections;

a value associated with each selection, which is revealed upon an acceptance of a selection or after the time period for the selection has lapsed; and an award provided to the player that includes values associated with each of the selections accepted by the player during the limited time periods respectively for said selections.

16. A gaming device comprising:

a display device;

a processor that communicates with a display device;

a plurality of selections that are each at least partially sequentially and individually presented to a player for a time period for said selection by the display device under the control of the processor;

an input in communication with the processor for enabling the player to accept one of the selections during the time period for said selection, the time period for said selection displayed by the display device;

a speed-change associated with a selection which changes the time period for accepting selections; and an award provided to the player that includes a value associated with each of the accepted selections.

17. The gaming device of claim 16, wherein the display device displays a value associated with one of the selections that is not accepted by the player within the time period for said selection.

18. The gaming device of claim 16, which includes a plurality of value ranges each associated with a different time period.

19. The gaming device of claim 18, wherein at least one value range includes an entry for the speed-change and is weighted so that the speed-change is weighted differently than a value in said value range.

20. The gaming device of claim 19, wherein upon acceptance of a selection that yields a speed-change, the time period decreases and a value range changes to one having a higher average value.

21. The gaming device of claim 19, wherein the award provided to the player includes values that are selected from the plurality of value ranges until a predefined number of values are accepted.

22. The gaming device of claim 19, wherein the award provided to the player includes values that are selected from the plurality of value ranges until a terminator is selected.

23. A gaming device comprising:

a display device;

a processor that communicates with the display device;

a plurality of selections that are each at least partially sequentially and individually presented to a player for a limited time period for said selection by the display device under the control of the processor, said limited time period for each selection based on the selection moving at a predefined velocity through a stationary distance, wherein one of the selections yields a velocity-change that changes the velocity of the selections;

an input in communication with the processor for enabling the player to accept each selection during said limited time period for said selection; and an award provided to the player that includes values associated with each of the selections accepted by the player respectively during the limited time periods of said selections.

24. The gaming device of claim 23, which includes a revealed award selection on the display device, wherein a non-accepted selection is revealed when it moves past the predefined distance.

25. A gaming device comprising:

a display device;

a processor in communication with the display device;

a plurality of selections that are each at least partially sequentially and individually presented to a player for a time period for said selection by the display device under the control of the processor, the time period displayed by the display device;

an input in communication with the processor for enabling the player to accept each of the selections during the time period for said selection;

a velocity-increase associated with one of the selections which changes the time period for accepting subsequent selections;

a plurality of value ranges each associated with a different time period; and an award provided to the player that includes a value associated with at least one accepted selection.

26. A gaming device comprising:

a display device;

a plurality of ranges of values;

a plurality of selections, wherein at least one of the selections yields both a value from one of said ranges of values and a velocity change;

a plurality of time periods each set by a selection moving at a predefined velocity through a stationary distance;

an input for enabling the player to pick the selections while moving through the stationary distance; and a processor in communication with the display device and the input, wherein the processor causes the display device to present at least one of the selections having values from a first one of the ranges during a first time period, causes the display device to present at least one of the selections having a value from a second ranges when a selection having a velocity-change is selected from the first range, and provides an award to the player based on the values associated with the selections picked by the player while moving through the stationary distance.

27. A gaming device comprising:

a display device;

a processor that communicates with the display device;

a plurality of selections that are each at least partially sequentially and individually presented to a player for a limited time period by the display device under the control of the processor, said limited time period for each selection based on said selections moving at a predefined velocity through a stationary distance, and wherein at least one of the selections yields a velocity-change which maintains said pre-defined velocity of said selection and which decreases the stationary distance;

an input in communication with the processor for enabling the player to accept each selection during said limited time period for said selection; and an award provided to the player that includes values associated with selections accepted by the player during the limited time periods of said selections.

28. A gaming device comprising:

a display device;

a processor that communicates with the display device;

a plurality of selections that are each at least partially sequentially and individually presented to a player for a limited time period for said selection by the display device under control of the processor, each said limited time period displayed to the player by said display device, wherein one of the selections yields a speed-change that increases the limited time period for at least one subsequent selection;

an input in communication with the processor for enabling the player to accept each selection during said limited time period for said selection; and an award provided to the player that includes values associated with each of the selections accepted by the player during the limited time periods respectively of said selections.

29. A gaming device comprising:

a display device;

a processor that communicates with the display device;

a plurality of selections that are each at least partially sequentially and individually presented to a player for a limited time period for said selection by the display device under the control of the processor, each said limited time period displayed to the player by said display device, which includes a plurality of value ranges associated with at least one selection which yields a speed-change, wherein the value ranges are each associated with a different length of time in which the player is enabled to accept said selections;

an input in communication with the processor for enabling the player to accept each selection during said limited time period for said selection; and an award provided to the player that includes values associated with each of the selections accepted by the player during the limited time periods respectively of said selections.

30. A gaming device comprising:

a display device;

a processor that communicates with the display device;

a plurality of selections that are each at least partially sequentially and individually presented to a player for a limited time period for said selection by the display device under the control of the processor, each said limited time period displayed to the player by said display device, wherein the limited time period for at least one of the selections is based on a displayed movement of said selection at a predefined speed through a predefined distance, wherein at least one selection yields a speed-change that increases the speed of the at least one selection on the display device from a first speed to a second speed, wherein one of the selections yields a velocity-change that holds the velocity of the selections constant and decreases the predefined distance;

an input in communication with the processor for enabling the player to accept each selection during said limited time period for said selection; and an award provided to the player that includes values associated with each of the selections accepted by the player during the limited time periods respectively of said selections.

31. A gaming device comprising:

a display device;

a processor that communicates with the display device;

a plurality of selections that are each at least partially sequentially and individually presented to a player for a limited time period for said selection by the display device under the control of the processor, said limited time period for each selection based on the selection moving at a predefined velocity through a stationary distance, wherein one of the selections yields a velocity-change that holds the velocity of the selections constant and decreases the predefined distance;

an input in communication with the processor for enabling the player to accept each selection during said limited time period for said selection; and an award provided to the player that includes values associated with each of the selections accepted by the player respectively during the limited time periods of said selections.

32. A gaming device comprising:

a display device;

a processor that communicates with the display device;

a plurality of selections that are each at least partially sequentially and individually presented to a player for a limited time period for said selection by the display device under the control of the processor, said limited time period for each selection based on the selection moving at a predefined velocity through a stationary distance, and which includes a plurality of value ranges that are each associated with a different selection velocity;

an input in communication with the processor for enabling the player to accept each selection during said limited time period for said selection; and an award provided to the player that includes values associated with each of the selections accepted by the player respectively during the limited time periods of said selections.

33. The gaming device of claim 30, which includes a first value range for one of the selection(s) moving at the first speed and a second value range for one of the selection(s) moving at the second speed.

34. The gaming device of claim 32, wherein the award provided to the player includes values selected from the plurality of value ranges until a predefined number of values are accepted.

35. The gaming device of claim 32, wherein if a picked selection yields a velocity-change, the velocity subsequently increases and one of the value ranges having a higher average value is subsequently used by the processor.

36. The gaming device of claim 35, wherein the value range having the higher average value also has a lower probability of yielding a velocity-change.

* * * * *